US007134551B2

(12) United States Patent
Harrelson

(10) Patent No.: US 7,134,551 B2
(45) **Date of Patent: *Nov. 14, 2006**

(54) DISPENSING SYSTEM FOR DOUBLE STACK CARTON

(75) Inventor: Glen R. Harrelson, Gainesville, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/139,827

(22) Filed: May 27, 2005

(65) Prior Publication Data

US 2005/0218203 A1 Oct. 6, 2005

Related U.S. Application Data

(63) Continuation of application No. 10/365,148, filed on Feb. 12, 2003, now Pat. No. 6,918,487.

(51) Int. Cl.
*B65D 75/00* (2006.01)
*B65D 17/00* (2006.01)
*A47F 1/04* (2006.01)

(52) U.S. Cl. ..... 206/427; 221/305; 229/122; 229/242

(58) Field of Classification Search ..... 206/427, 206/429–430; 221/303, 305–309; 229/240–242
See application file for complete search history.

(56) References Cited

U.S. PATENT DOCUMENTS 3,356,279 A 12/1967 Root
4,318,474 A 3/1982 Hasegawa
4,331,289 A 5/1982 Killy
4,364,509 A 12/1982 Holley, Jr. et al.
4,396,143 A 8/1983 Killy
4,498,581 A 2/1985 Dutcher
4,577,799 A 3/1986 Oliff
3,265,283 A 8/1986 Farquhar
4,974,731 A * 12/1990 Wood ..... 229/229
5,368,194 A * 11/1994 Oliff et al. ..... 221/305
5,505,372 A 4/1996 Edson et al.
6,478,219 B1 11/2002 Holley, Jr.
6,578,736 B1 6/2003 Spivey
6,669,083 B1 12/2003 Bates
6,715,639 B1 4/2004 Spivey
6,918,487 B1 * 7/2005 Harrelson ..... 206/427
6,991,107 B1 * 1/2006 Harrelson ..... 206/427
2003/0150759 A1 * 8/2003 White, Jr. ..... 206/427

* cited by examiner

*Primary Examiner*—Bryon P. Gehman
(74) *Attorney, Agent, or Firm*—Womble Carlyle Sandridge & Rice, PLLC

(57) ABSTRACT

The carton of this invention is capable of carrying the plurality of containers stacked upon their ends in two tiers with a unique dispenser that permits the dispensing of containers on their sides. The dispenser is formed in a top side wall and extends into the end wall with most of the end wall being torn open but leaving a portion near the bottom side wall to prevent the bottom layer of containers from rolling out. Angled projections in the dispensing end of the carton near the top panel and bottom panel prevent the top layer of containers from rolling out. A divider may be inserted between the two tiers of containers to facilitate loading the carton and preventing the containers from accidentally rolling out when the dispenser is open.

60 Claims, 4 Drawing Sheets

DISPENSING SYSTEM FOR DOUBLE STACK CARTON

CROSS-REFERENCE TO RELATED APPLICATION

This application is a continuation of U.S. patent application Ser. No. 10/365,148, filed Feb. 12, 2003, now U.S. Pat. No. 6,918,487, which is hereby incorporated herein by reference in its entirety.

BACKGROUND OF THE INVENTION

1. Field of the Invention

The present invention relates generally to an enclosed paperboard carton capable of enclosing containers in two tiers, which carton has a unique opening and dispensing feature that allows the containers, for example, cans, to be removed or dispensed one container per tier at a time without destroying the overall structural integrity of the carton. The unique opening and dispensing feature can be incorporated in cartons containing a plurality of layers of containers stacked on end and still limit the dispensing to one container per tier at a time.

2. Background

Fully enclosed cartons capable of enclosing cans have been used in the past that have a feature for dispensing the cans one at a time. Dispensers have been provided at various locations on these cartons depending on the design.

Cartons have been introduced into the marketplace that can carry 24 or more containers, for example cans, in two stacks or tiers. So far no satisfactory dispenser has been developed for dispensing the layers of cans in these two stack cartons one at a time from each stack or tier. Consequently, when these cartons are opened they tend to let a number of the cans roll out which has not allowed these twin stack cartons to achieve their full potential.

3. Prior Art

U.S. Pat. No. 3,265,283 to Farquhar discloses a fully enclosed carton having a dispenser for dispensing the enclosed cans. The end wall of the carton has a dispensing flap which can be folded down upon opening. An aperture formed by the flap extends into the side walls to permit grasping of the can to withdraw it from the carton. When the flap is opened, the cans are held in the carton by an arcuate flap portion extending downwardly in the end wall into the center of the aperture. The structural integrity of this carton is compromised because the entire bottom end of the carton is opened. It will be realized that the design of this dispenser is not satisfactory for dispensing containers, for example cans, that are stacked in twin stacks in a carton.

U.S. Pat. No. 4,364,509 to Holly, Jr. et al. also discloses a fully enclosed carton with a dispenser in one of the end walls. This dispenser is likewise formed in the end wall by tearing out an end flap and lowering it into proper position. Expansion slits are provided in the side wall for the user's fingers to grasp the ends of the existing can. The dispenser of this carton is not satisfactory for use in a twin stack carton for carrying containers.

SUMMARY OF THE INVENTION

It is an object of this invention to develop a dispenser for dispensing containers, for example cans, one at a time from a carton containing containers in two stacks or tiers. It is the further object of this invention to develop a dispenser that can be easily opened. A further object of this invention is to develop a dispenser that can be used for containers stacked in a 3 by 4 configuration in each stack to be dispensed one at a time from each stack without the containers rolling out accidentally. A final object of this invention is to develop a dispenser for a twin stack carton that does not destroy the structural integrity of the carton when it is opened.

Briefly described, in its preferred form, the objects of this invention are achieved by providing an enclosed carton for carrying containers in two tiers for dispensing the containers one at a time from each tier from the exiting end of the carton. The carton is generally rectangular and has a bottom, top, two sides, a closed end and exiting end. The carton is foldably constructed from a blank having panels and flaps. The carton is designed to carry containers, e.g. cans, that are stacked on their ends in two tiers from the bottom panel to the top panel. The dispenser is constructed by providing tear lines in one of the side panels that extend into the exiting end of the carton which is rested on the other side panel, with the dispenser being capable of dispensing the containers as they are resting on their sides. A tear line is provided in the end of the carton placed from the side upon which the carton rests while dispensing containers at a sufficient distance to prevent any of the containers below the top layer of containers from rolling out of the carton when the dispenser is open. A pair of tear lines extend from this bottom tear line from each end at an angle from the bottom tear line to the top side panel in which part of the dispenser is formed. The angle and distance of the projection is such as to restrain the top layer of cans in each tier from accidentally rolling out. The dispenser is constructed with a large enough opening in the top side panel in which it is formed to permit a person to grasp and remove a container in each tier one at a time.

This carton can be designed with a dispenser dispensing containers in a 3 by 4 configuration in each tier. The bottom tear line is located so as to prevent the bottom layers of containers from rolling out of the carton. A pair of tear lines extending from the ends of the bottom tear line are placed at an angle designed to restrain containers in the top layer from rolling out of the carton.

Because a carton for carrying 24 containers is placed under a great deal of stress, the top panel can be constructed from two handle flaps having a reinforcing strip attached to the inside handle flap folded over against the inside of the carton between the two oval handle apertures carrying the carton.

To facilitate holding the containers and dispensing them one at a time a divider may be provided between each tier of containers.

To facilitate opening the carton dispenser, a pull tab can be provided in the side panel where part of the dispenser is located, with the pull tab being loosely attached to the panel, but tightly attached to the dispenser for opening the dispenser.

Preferably the exiting end of the carton has four flaps for closing this end. An end flap attached to the side of the carton on which it is resting while the containers are being dispensed is generally not removed and serves to restrain one or more of the bottom layers of containers from rolling out of the carton. Preferably the tear lines in the end flaps attached to the top panel, and bottom panel are constructed so that a portion of each of these flaps is not removed and are glued to the flap attached to the side panel on which the carton rests during dispensing to preserve the integrity of the carton.

Other objects, features and advantages of this invention will become apparent upon reading the following specification, when taken in conjunction with the accompanying drawings.

DETAILED DESCRIPTION OF THE PREFERRED EMBODIMENTS

Figure 1:
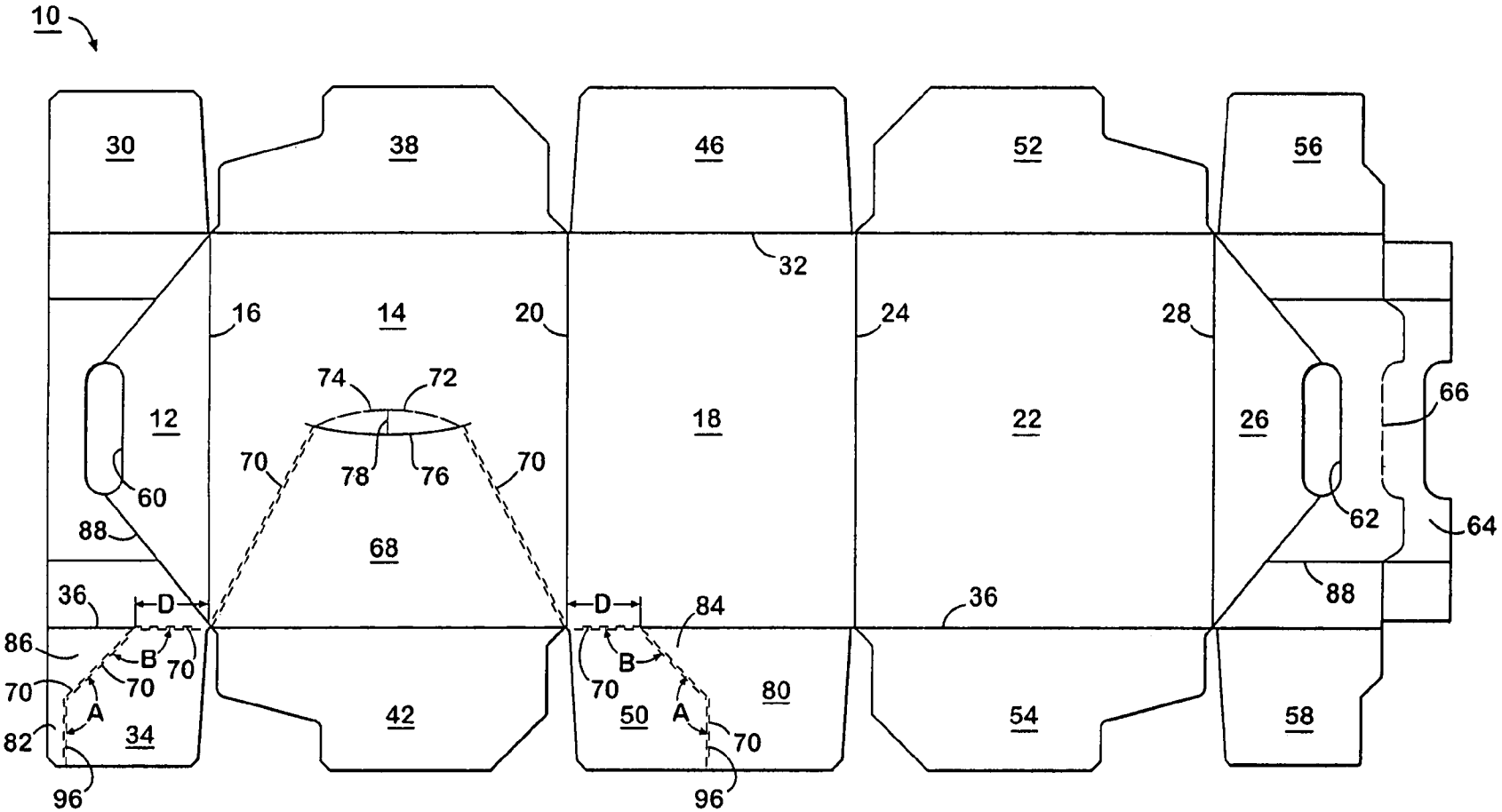
FIG. 1 is a plan view of the blank of the preferred embodiment of this invention from which a carton is formed.

The present invention is intended primarily for use with cans of the types used to contain soft drinks, beer and the like. The blank 10 is formed from a foldable sheet of material, such a paperboard. The blank 10 has an outside handle flap 12 which is attached to the top side panel 14 by fold line 16 which in turn is attached to bottom panel 18 by fold line 20, which in turn is attached to bottom side panel 22 by fold line 24. Bottom side panel 22 is foldably attached to inside handle flap 26 by fold line 28. The carton is supplied with a number of end flaps for closing the ends of the carton. The outside handle flap 12 is attached to outside top end flap 30 by fold line 32 and outside handle flap 12 is attached to outside top end flap 34 by fold line 36. Top side flap 38 is attached to top side panel 14 by fold line 32. Top side panel 14 is attached to top side flap 42 by fold line 36. Bottom panel 18 is attached to bottom end flap 46 by fold line 32 and to bottom end flap 50 by fold line 36. Bottom side panel 22 is attached to bottom side flap 52 by fold line 32 and to bottom side flap 54 by fold line 36. Inside handle flap 26 is attached to inside top end flap 56 by fold line 32 and to the inside top end flap 58 by fold line 36.

This carton has a pair of race track handles 60 and 62 formed in outside handle flap 12 and inside handle flap 26 respectively. Because this carton is designed to carry 24 containers, such as cans, it is provided with a handle reinforcing flap 64 attached to inside handle flap 26 by fold line 66.

A dispensing flap 68 is partially formed in top side panel 14 by tear line 70. To facilitate opening this dispenser, a pull tab 72 is provided to facilitate opening the dispensing flap 68. The pull tab 72 is loosely attached to top side panel 14. Pull tab 72 has a slit 74 between it and top side panel 14 to ease pulling of the pull tab from the plane of top side panel 14. Pull tab 72 is attached to dispensing flap 68 by fold line 76. A slit 78 may be provided in the middle of pull tab 72 to ease its removal from top side panel 14.

It will be understood by those skilled in the art that the carton of the present invention is generally symmetrical about a horizontal line of bisection, as viewed when FIG. 1 is rotated lengthwise. This symmetry aids in the efficient production of the present carton.

Figure 7:
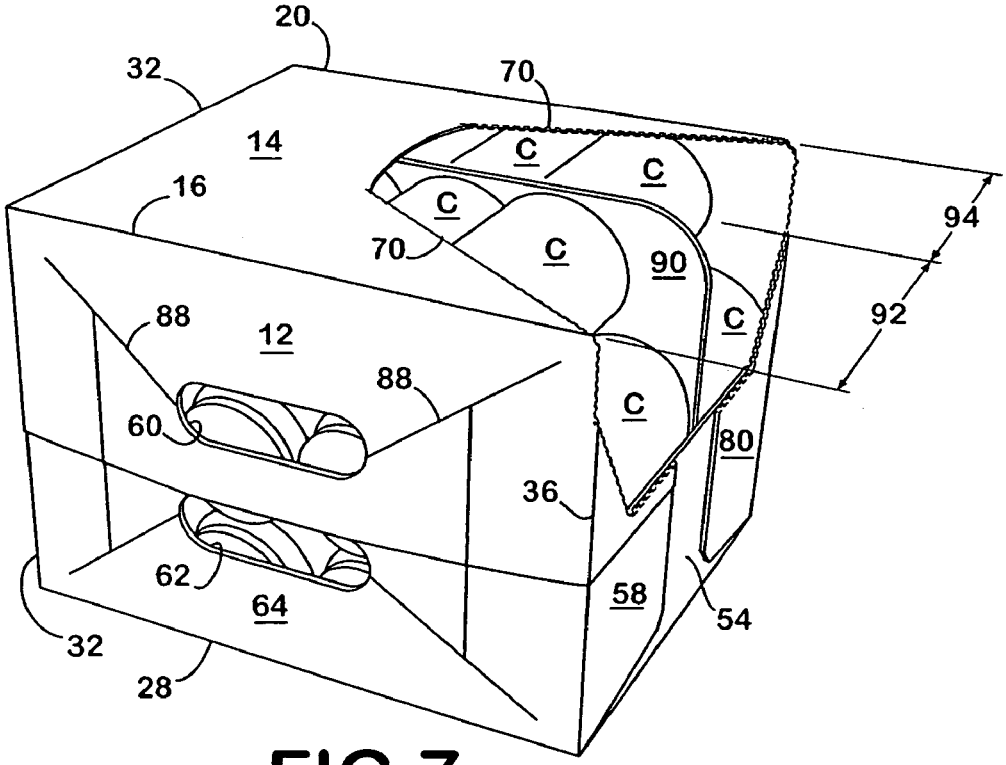
FIG. 7 is a perspective end view of the carton of FIG. 6 showing that a can has been removed from the top tier and from the bottom tier of cans.

In forming this blank 10 into a carton, the handle reinforcing flap 64 is folded along fold line 66 and glued to the inside handle flap 26. The blank 10 is then folded so that outside handle flap 12 is glued to inside handle flap 26 so that the two oval handles 60 and 62 are parallel to each other. These steps result in forming a carton sleeve in which cans can be loaded in the bottling plant. The cans can be placed in two tiers of a 3 by 4 configuration. This is best illustrated in FIG. 7 which shows the top tier 92 located near the top of the carton and the bottom tier 94 located near the bottom of the carton. In order to maintain the two tiers of cans in proper alignment during loading and when dispensed to the consumer, a divider 90 may be necessary. The divider 90 can be made out of a single sheet of paperboard.

After the two tiers of cans have been loaded into the carton various end flaps on both ends are closed and glued. To use the end of the carton where the dispenser is located as an example, the top side flap 42 is folded inwardly, bottom side flap 54 is folded inwardly, bottom end flap 50 is folded in an overlapping position, and glued to top side flap 42 and bottom side flap 54. Outside top end flap 34 and inside top end flap 58 are glued together to form a single top end flap which is likewise glued to top side flap 42 and bottom side flap 54. The other end of the carton is closed in the same manner.

When the dispenser is opened, dispensing flap 68, which includes top side flap 42, is removed from the carton along with a portion of outside end flap 34 and bottom end flap 50 along tear line 70. In order to preserve the structural integrity of the carton after the dispenser has been opened, it is important that end retention panel 82 be glued to inside top end flap 58 which in turn is glued to bottom side flap 54. Otherwise, the end retention projection 86 will not be firmly attached to carton. It is likewise important that end retention panel 80 be glued to bottom side flap 54 in order to ensure that end retention projection 84 is firmly attached to the carton after the dispenser is opened.

It should be realized that dispensers could be placed on both ends of the carton, but preferably it is only placed on one end. Cans can be removed from the exiting end of the carton after tear line 70 has been torn. The pair of tear lines 70 converge towards each other towards pull tab 72. Tear line 70 extends along fold line 36 between bottom end flap 50 and bottom panel 18 for a distance D and turns at an angle B and turns again at angle A to form a portion of bottom tear line 96. On the other side of top side panel 14, tear line 70 extends to fold line 36 and extends along that line and turns into the interior of outside top end flap 34 at angle B until it turns to form bottom line 96 at angle A.

Figure 2:
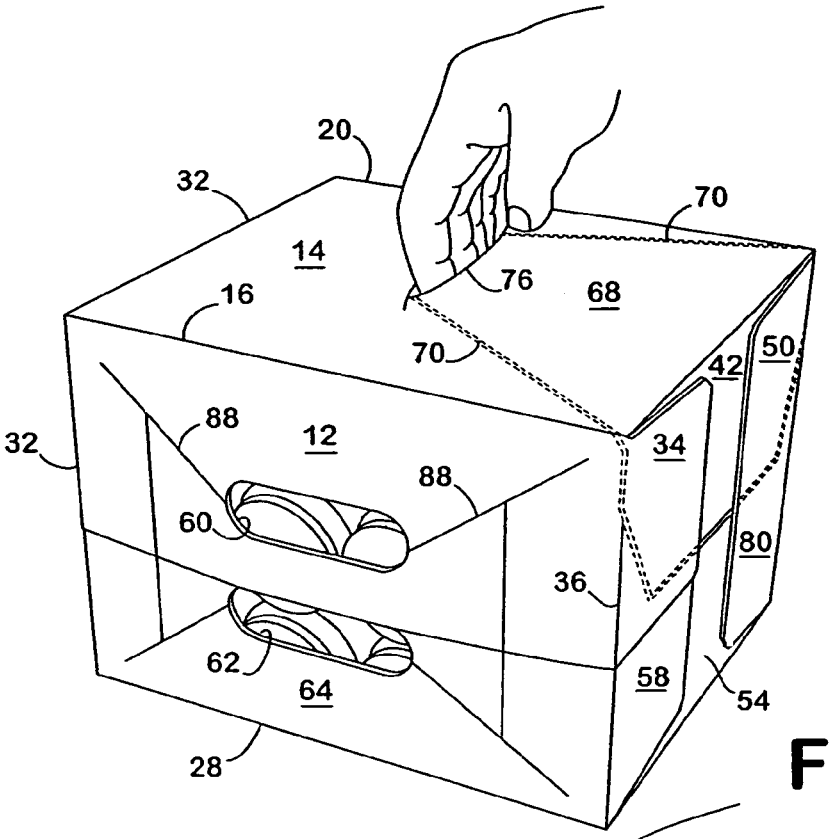
FIG. 2 is a perspective top view of the carton of the preferred embodiment loaded with two tiers of cans in a 3 by 4 configuration in each tier with a person starting to open the dispenser.
Figure 3:
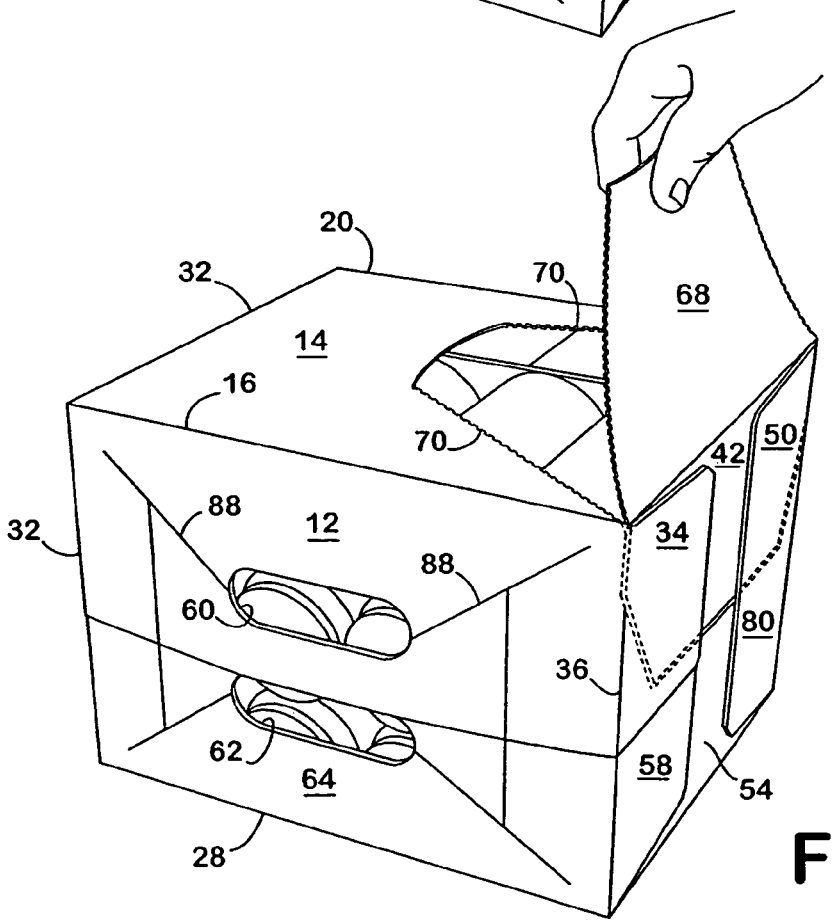
FIG. 3 is a perspective top view of the carton with a dispenser pulled part way open.
Figure 4:
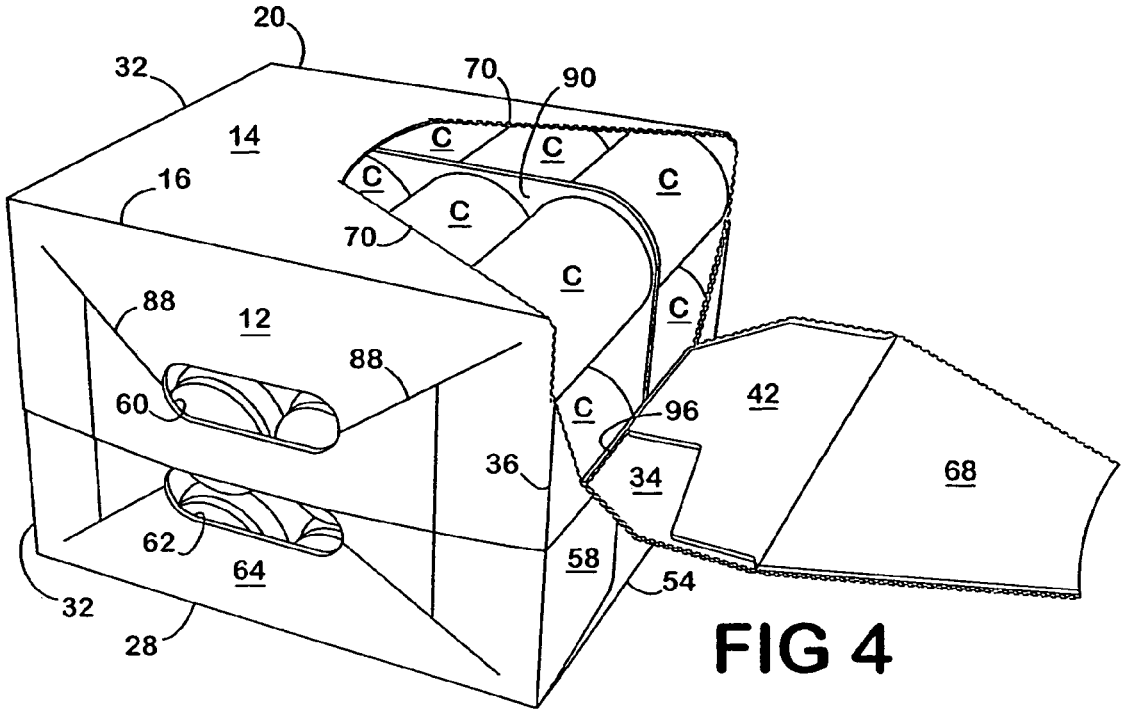
FIG. 4 is a perspective end view of the carton with cans in each tier in a 3 by 4 configuration with the dispenser being opened except for the bottom tear line.
Figure 5:
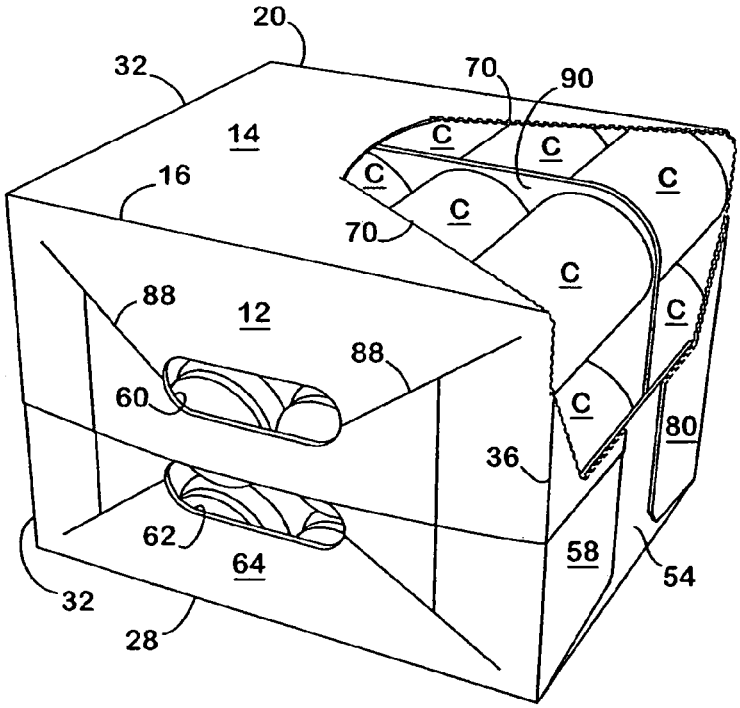
FIG. 5 is perspective end view of the carton loaded with two tiers of cans in a 3 by 4 configuration with the dispenser completely removed but all the cans being contained in the carton.

The consumer can open dispensing flap 68 by inserting his or her fingers into pull tab 72 which is an easy maneuver because of slit 74. In place of slit 74, a tear line that is loosely attached to top side panel 14 may be substituted in lieu of the slit. Insertion of the fingers into the aperture formed by depressing pull tab 72 is illustrated in FIG. 2. It will be noticed that the carton has been turned 9O° so that it rests on bottom side panel 22. Outside handle flap 12 and inside handle flap 26 form the top panel. The consumer precedes to pull pull tab 72 upward which is connected by fold line 76 to dispensing flap 68 which is pulled up as illustrated in FIG. 3. Continued tearing open of the dispenser is illustrated in FIG. 4. The dispenser is opened along tear line 70 which extends on both sides so that the dispensing flap 68 is torn open along fold line 36 and into the interior of outside top end flap 34 and bottom end flap 50 as illustrated in FIG. 4. The tearing continues down to the point where tear line 70 forms bottom tear line 96 which has not yet been torn as shown in FIG. 4. FIG. 5 illustrates a complete removal of the dispenser by tearing along bottom tear line 96. Even though the entire dispenser has been removed in FIG. 5, the cans are retained in the carton even though the cans are lying on their sides. The bottom two layers of cans in the 3 by 4 configuration are prevented from rolling out of the carton by bottom side flap 54 to which end retention panels 80 and 82 are glued. It will be noticed that bottom side flap 54 only extends part way up the diameter of the cans in the second layer of the two tiers. The top layer of cans in the two tiers is prevented from rolling out by end retention projections 84 and 86. Tear line 70 only extends along fold line 36 a distance D which is slightly less than the diameter of the top layer of cans being contained. This is sufficient to prevent the top layer of cans from rolling out of the carton but yet not prevent an obstacle to their easy removal by the consumer. Tear line 70 turns at an angle B and then turns again at angle A to form the bottom tear line 96 on both outside top end flap 34 and bottom end flap 50. It will be realized that end retention projections 84 and 86 are helpful in retaining the top layer of cans in the carton. The extent of this help depends upon the location of the bottom tear line 96 in relation to the layers of cans C.

Figure 6:
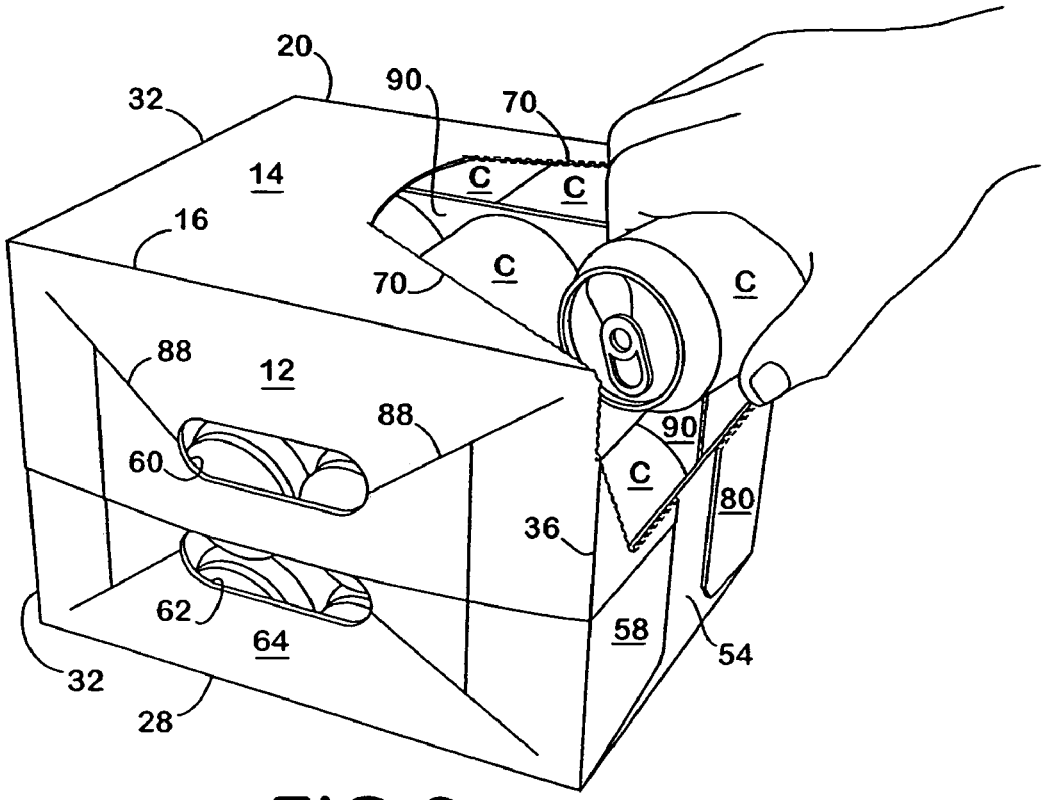
FIG. 6 is a perspective end of the carton of FIG. 5 showing a person removing a can from the top tier of cans.

FIG. 6 illustrates a consumer removing a can from the top tier 92 of cans C. It will be noticed that the consumer moves a can by twisting it slightly along its longitudinal axis and removing the bottom end of the can C first as it easily slides along the divider 90. It is necessary to remove the can in this way as the top of the can is retained in position by end retention projection 86. The end retention projections 84 and 86 are important as it is desirable that the cans in the top layer not roll out when the dispenser is open. The divider 90 and end retention projections 84 and 86 are designed to ensure that the top layer of cans adjacent the dispenser not roll out accidentally. FIG. 7 illustrates a carton with cans from each tier having been removed with the remaining cans held in place.

Because the blank 10 is designed to carry 24 cans in two tiers, it will be appreciated that the carton is heavy when loaded with cans. It is preferred that the top panel be composed of an outside handle flap 12 and an inside handle flap 26 and handle reinforcing flap 64 be utilized. In addition, stress lines 88 that are designed to dissipate the stress posed by lifting the carton handle 60 and 62 can be utilized. It should be realized that the carton sleeves can be glued together at other locations but is preferred to be glued at the top panel.

It will be noticed that the tear lines 70 in top side panel 14 converge towards each other and extend away from fold line 36 to provide a large enough opening when dispensing flap 68 is removed to permit a person to grasp cans in the top layer in each tier near the exiting end of the carton.

A carton for carrying cans is preferred since these containers have ends that are of the same diameter as the body of the container.

UNIQUE FEATURES OF THE DISPENSER OF THIS INVENTION

One of the unique features of the dispenser of this invention is that is permits the easy dispensing of containers that are stacked in two tiers. The carton is unique in that it carries the containers in their upright position, but dispenses them when the containers are on their side. Placement of the bottom tear line in the dispenser will restrain all but the top layer of containers from rolling out. An angled projection on each side of the dispenser can be utilized to prevent the top layer of containers from rolling out. The provision of a divider is important in maintaining the configuration of the containers into two tiers during loading and dispensing.

While the invention has been disclosed in its preferred forms, it will be apparent to those skilled in the art that many modifications, additions, and deletions can be made therein without departing from the spirit and scope of the invention and its equivalents as set forth in the following claims.

Therefore, having thus described the invention, at least the following is claimed:

1. An enclosed carton containing a plurality of cylindrical containers arranged in stacked layers from a topmost layer to a bottommost layer, including a first layer and a second layer thereabove, the containers in each layer lying on their sides with the containers in the first layer contacting the containers in the second layer along a substantially horizontal plane, the carton comprising:

a first panel adjacent and above the topmost layer and a second panel adjacent and below the bottommost layer, a third panel joining one edge of the first panel to one edge of the second panel, a fourth panel joining an other edge of the first panel to an other edge of the second panel, and two closed ends, at least one of the two closed ends being an exiting end, each closed end extending from the first panel to the second panel and from the third panel to the fourth panel;

a continuous tear line defining a removable portion that is removable from the carton to form an opening;

the opening comprising (1) a first area that includes a part of the first panel extending away from its intersection with the at least one exiting end, and (2) a second area that includes a part of the at least one exiting end extending downwardly from its intersection with the first panel;

the second area having a bottom edge which extends across the at least one exiting end below the first panel and between the third panel and the fourth panel, and comprises (1) at least one first portion positioned at a first level, the first level being lower than the substantially horizontal plane; and (2) at least one second portion that extends from a second level, the second level being below the intersection of the at least one exiting end and the first panel and higher than the substantially horizontal plane, the at least one second portion extending from said second level to the at least one first portion of the bottom edge.

2. The carton of claim 1, where the at least one first portion of the bottom edge is substantially equidistant between the third panel and the fourth panel.

3. The carton of claim 1, wherein the at least one second portion of the bottom edge extends from the intersection of the at least one exiting end and one of the third and fourth panels.

4. The carton of claim 1, wherein the bottom edge includes two second portions, each of which extends from the second level to the first portion of the bottom edge.

5. The carton of claim 1, wherein the bottom edge of the opening extends from the intersection of the at least one exiting end and the third panel at the second level to the first level, then from the first level to the intersection of the at least one exiting end and the fourth panel at the second level.

6. The carton of claim 1, wherein the bottom edge prevents the containers in the second layer from rolling out of the carton when the removable portion is removed.

7. The carton of claim 1, wherein the bottom edge prevents the containers in the first layer from rolling out of the carton when the removable portion is removed.

8. The carton of claim 1, wherein the at least one first and second portions of the bottom edge prevent the containers in the first and second layers from rolling out of the carton when the removable portion is removed.

9. The carton of claim 1, including means for facilitating opening of the opening located on the first panel.

10. The carton of claim 1, wherein there are three layers of containers.

11. The carton of claim 10, wherein the containers are stacked in a 3-by-4 configuration.

12. The carton of claim 1, wherein the containers in the second layer are removable through the opening.

13. The carton of claim 1, wherein the containers are oriented with their longitudinal axes parallel to the at least one exiting end.

14. An enclosed carton containing a plurality of cylindrical containers having a diameter and arranged on their sides in stacked horizontal layers, including a first layer and a second layer above and adjacent the first layer, the carton comprising:

a first upper horizontal panel, a second lower horizontal panel, and third and fourth vertical side panels, the first, second, third and fourth panels being joined at their edges, the carton having two closed ends, at least one of which is an exiting end;

a tear line defining a removable portion that is removable from the carton to form an opening;

the removable portion including a section of the first panel adjacent the at least one exiting end, and a section of the at least one exiting end adjacent the first panel;

the section of the at least one exiting end including an upper portion and a lower portion;

the lower portion having a width that is less than the width of the at least one exiting end, the lower portion extending upwardly to the upper portion from a first level which is part way up the diameter of the containers in the first layer;

the upper portion extending from one side of the at least one exiting end to the other;

wherein the upper portion meets the lower portion at a second level that is above the diameter of the containers in the first layer and below the top of the containers in the second layer.

15. The carton of claim 14, wherein the distance of the second level from the top of the upper portion is slightly less than the distance of the bottom of the containers in the second layer from the top of the upper portion.

16. The carton of claim 14, wherein the second level is so located that when the removable portion is removed, the second layer of containers will be prevented from rolling out of the carton.

17. The carton of claim 14, wherein the lower portion is so configured that when the removable portion is removed, the first and second layers of containers will be prevented from rolling out of the carton.

18. The carton of claim 14, wherein the width of the lower portion increases as it extends upwardly to said upper portion.

19. The carton of claim 14, including means for facilitating removal of the removable portion on the first panel.

20. The carton of claim 14, including three layers of containers.

21. The carton of claim 20, wherein the containers are stacked in a 3-by-4 configuration.

22. The carton of claim 14, wherein the containers are oriented with their longitudinal axes parallel to the at least one exiting end.

23. A carton enclosing a plurality of cylindrical articles arranged on their sides in rows and columns, a first column being adjacent a first end of the carton, a top row cylindrical article being in a top row, being in the first column, and having a diameter, the carton comprising:

a top panel, two side panels, and a bottom panel;

at least one flap forming the first end of the carton and at least one flap forming a second end of the carton;

the first end comprising a detachable portion and a retainer portion;

the detachable portion removes an upper portion of the first end that is less than the diameter of the top row cylindrical article; and the retainer portion retains the top row cylindrical article in the carton after the detachable portion is removed.

24. The carton of claim 23, wherein an upper portion of the top row cylindrical article is adjacent the top panel of the carton, and wherein the upper portion of the top row cylindrical article is exposed when the detachable portion is removed from the carton.

25. The carton of claim 23, wherein the retainer portion extends obliquely toward a lower portion of the first end.

26. The carton of claim 23, wherein the detachable portion extends obliquely downward from a side panel to a parallel portion parallel to the bottom panel.

27. The carton of claim 26, wherein the parallel portion is disposed lower than the retainer portion that retains the top row cylindrical article.

28. The carton of claim 26, wherein removal of the detachable portion creates an opening in the first end to allow removal of a cylindrical article in a row below the top row after the top row cylindrical article has been removed from the carton.

29. The carton of claim 23, wherein the structural integrity of the carton is maintained after removal of the detachable portion.

30. The carton of claim 23, wherein a finger flap assists removal of the detachable portion.

31. The carton of claim 30, wherein the finger flap is disposed in the top panel.

32. The carton of claim 23, wherein the detachable portion is formed by a substantially continuous tear line that extends in the first end below the top panel a first distance and extends at a first angle and at a second angle on either side of a parallel portion parallel to the bottom panel.

33. A package comprising a plurality of cylindrical articles disposed on their sides in rows and columns, a first column being adjacent a first end of the package, a top row cylindrical article being in a top row, being in the first column, and having a diameter, the package comprising:

a top panel, two side panels, and a bottom panel;

at least one flap forming the first end of the package and at least one flap forming a second end of the package;

the first end comprising a detachable portion and a retainer portion;

the detachable portion removes an upper portion of the first end that is less than the diameter of the top row cylindrical article; and the retainer portion retains the top row cylindrical article in the package after the detachable portion is removed.

34. The package of claim 33, wherein an upper portion of the top row cylindrical article is adjacent the top panel of the package, and wherein the upper portion of the top row cylindrical article is exposed when the detachable portion is removed from the package.

35. The package of claim 33, wherein the retainer portion extends obliquely toward a lower portion of the first end.

36. The package of claim 33, wherein the detachable portion extends obliquely downward from a side panel to a parallel portion parallel to the bottom panel.

37. The package of claim 36, wherein the parallel portion is disposed lower than the retainer portion that retains the top row cylindrical article.

38. The package of claim 36, wherein removal of the detachable portion creates an opening in the first end to allow removal of a cylindrical article in a row below the top row after the top row cylindrical article has been removed from the package.

39. The package of claim 33, wherein the structural integrity of the package is maintained after removal of the detachable portion.

40. The package of claim 33, wherein a finger flap assists removal of the detachable portion.

41. The package of claim 40, wherein the finger flap is disposed in the top panel.

42. The package of claim 33, wherein the detachable portion is formed by a substantially continuous tear line that extends in the first end below the top panel a first distance and extends at a first angle and at a second angle on either side of a parallel portion.

43. A carton enclosing a plurality of cylindrical articles arranged on their sides in rows and columns, a first column being adjacent a first end of the carton, the carton comprising:

a top panel, two side panels, and a bottom panel;

at least one flap forming the first end of the carton and at least one flap forming a second end of the carton;

the first end comprising a detachable portion and a retainer portion;

the detachable portion removes an upper portion of the first end that is less than a diameter of a cylindrical article; and the retainer portion retains all the cylindrical articles in the first column in the carton after the detachable portion is removed.

44. A carton blank comprising:

a top panel including a finger flap;

a first side panel foldably connected to the top panel at a first fold line;

a second side panel foldably connected to the top panel at a second fold line;

a first side panel end flap foldably connected to the first side panel at a third fold line;

a second side panel end flap foldably connected to the second side panel at a fourth fold line;

at least one tear line defining a dispenser flap in the top panel;

wherein the at least one tear line extends from the finger flap obliquely to the first side panel end flap and obliquely to the second side panel end flap; wherein the at least one tear line extends a distance D along the third fold line and along the fourth fold line; wherein the at least one tear line extends obliquely at an angle B in the first side panel end flap and in the second side panel end flap, continues a distance, extends obliquely at an angle A in the first side panel end flap and in the second side panel end flap, and extends to a marginal portion of the first side panel end flap and the second side panel end flap.

45. A carton formed from the blank of claim 44.

46. A method of erecting a carton from the blank of claim 44.

47. In combination, a parallelepiped carton formed from the blank of claim 44, and a plurality of containers within the carton.

48. A carton blank comprising:

a first panel including a finger flap and a first panel end flap;

a second panel foldably connected to the first panel at a first fold line;

a third panel foldably connected to the first panel at a second fold line;

a second panel end flap foldably connected to the second panel at a third fold line;

a third panel end flap foldably connected to the third panel at a fourth fold line;

at least one tear line defining a dispenser flap in the first panel;

wherein the at least one tear line extends from the finger flap obliquely to the second panel end flap and obliquely to the third panel end flap; wherein the at least one tear line extends a distance D both along the third fold line and along the fourth fold line; wherein the at least one tear line extends obliquely at an angle B in the second panel end flap and in the third panel end flap, continues a first distance, extends obliquely at an angle A in the second panel end flap and in the third panel end flap, and extends to a marginal portion of the second panel end flap and the third panel end flap.

49. A carton formed from the blank of claim 48.

50. A method of erecting a carton from the blank of claim 48.

51. In combination, a parallelepiped carton formed from the blank of claim 48, and a plurality of containers within the carton.

52. A carton blank comprising:

a first panel;

a second panel;

a third panel;

a second panel end flap;

a third panel end flap;

at least one tear line in the first panel;

wherein the at least one tear line extends from an intermediate portion of the first panel obliquely to the second panel end flap and obliquely to the third panel end flap; wherein the at least one tear line extends a distance D both along the second panel end flap and along the third panel end flap; wherein the at least one tear line extends obliquely at an angle B in the second panel end flap and in the third panel end flap, continues a first distance, extends obliquely at an angle A in the second panel end flap and in the third panel end flap, and extends to a marginal portion of the second panel end flap and the third panel end flap.

53. The blank of claim 52 wherein the first panel includes a finger flap and a first panel end flap.

54. The blank of claim 52 wherein the second panel is foldably connected to the first panel at a first fold line.

55. The blank of claim 54 wherein the third panel is foldably connected to the first panel at a second fold line.

56. The blank of claim 55 wherein the second panel end flap is foldably connected to the second panel at a third fold line.

57. The blank of claim 56 wherein the third panel end flap is foldably connected to the third panel at a fourth fold line.

58. A carton formed from the blank of claim 52.

59. A method of erecting a carton from the blank of claim 52.

60. In combination, a parallelepiped carton formed from the blank of claim 52, and a plurality of containers within the carton.

* * * * *